US011015235B2

(12) United States Patent
Inoue et al.

(10) Patent No.: US 11,015,235 B2
(45) Date of Patent: May 25, 2021

(54) METHOD FOR PRODUCING ALUMINUM ALLOY MEMBER, AND ALUMINUM ALLOY MEMBER OBTAINED BY SAME

(71) Applicant: MITSUBISHI HEAVY INDUSTRIES, LTD., Tokyo (JP)

(72) Inventors: Akiko Inoue, Tokyo (JP); Takayuki Takahashi, Tokyo (JP); Hiroaki Sato, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 611 days.

(21) Appl. No.: 15/511,005

(22) PCT Filed: Oct. 13, 2015

(86) PCT No.: PCT/JP2015/078932
§ 371 (c)(1),
(2) Date: Mar. 13, 2017

(87) PCT Pub. No.: WO2016/060117
PCT Pub. Date: Apr. 21, 2016

(65) Prior Publication Data

US 2017/0275739 A1 Sep. 28, 2017

(30) Foreign Application Priority Data

Oct. 17, 2014 (JP) ..... JP2014-212671

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
CPC ..... C22C 21/10; C22F 1/053; C22F 1/04
See application file for complete search history.

(56) References Cited

U.S. PATENT DOCUMENTS 3,580,747 A * 5/1971 Howitt ..... C22C 21/10 148/695
5,435,161 A * 7/1995 King ..... B21C 31/00 72/16.5

(Continued)

FOREIGN PATENT DOCUMENTS

CN 102676962 A 9/2012
CN 103045974 A * 4/2013

(Continued)

OTHER PUBLICATIONS

Davis, J.R., "ASM Specialty Handbook—Aluminum and Aluminum Alloys" (ASM International, 1993). p. 295, Table 3. (Year: 1993).*
JP-2012246555-A machine translation (Year: 2012).*
CN-103045974-A machine translation (Year: 2013).*
J.R. Davis, "Metals Handbook—Desk Edition", Dec. 1998, ASM International, USA, XP002777857, ISBN: 0-87170-654-7, p. 430, 3pp. (Year: 1998).*

(Continued)

*Primary Examiner* — Anthony J Zimmer
*Assistant Examiner* — Sean P. O'Keefe
(74) *Attorney, Agent, or Firm* — Hauptman Ham, LLP

(57) ABSTRACT

A method for producing an aluminum alloy member includes an extrusion step for subjecting an aluminum (Al) alloy which contains from 1.6% by mass to 2.6% by mass (inclusive) of magnesium (Mg), from 6.0% by mass to 7.0% by mass (inclusive) of zinc (Zn), 0.5% by mass or less of copper (Cu), from 0.01% by mass to 0.05% by mass (inclusive) of titanium (Ti) with the balance made up of aluminum (Al) and unavoidable impurities to hot extrusion. The method further includes a cooling step for cooling the aluminum alloy after the extrusion. The method further includes a strain processing step for introducing strain that miniaturizes precipitates precipitated in the crystal grains of the aluminum alloy after the cooling. The method further includes an aging step for aging the aluminum alloy by heating.

4 Claims, 6 Drawing Sheets

(56) References Cited

U.S. PATENT DOCUMENTS

| | | | | |
|---|---|---|---|---|
| 2006/0151075 | A1 | 7/2006 | Van Der Veen et al. | |
| 2012/0085470 | A1 | 4/2012 | Segal | |
| 2012/0234440 | A1 | 9/2012 | Miyata et al. | |
| 2014/0209222 | A1 * | 7/2014 | Shikama | C22C 21/10 148/695 |

FOREIGN PATENT DOCUMENTS

| | | | | |
|---|---|---|---|---|
| EP | 3135790 | A1 | | 3/2017 |
| JP | 2-73941 | A | | 3/1990 |
| JP | 2011-241449 | A | | 12/2011 |
| JP | 2012-207302 | A | | 10/2012 |
| JP | 2012-246555 | A | | 12/2012 |
| JP | 2012246555 | A | * | 12/2012 |
| WO | 2008/123184 | A1 | | 10/2008 |
| WO | 2012/165086 | A | | 12/2012 |
| WO | 2015/182748 | A1 | | 12/2015 |

OTHER PUBLICATIONS

Written Opinion in PCT/JP2015/078932, dated Jan. 12, 2016.

50 Shunen Kinen, "Aluminium no Seihin to Seizo Gijutsu", The Japan Institute of Light Metals, Jigyo Jikko Iinkai Kinen Shuppanbukai, Oct. 31, 2001, pp. 399 to 407.

40 Shunen Kinen, "Aluminium no Soshiki to Seishitsu", The Japan Institute of Light Metals, Jigyo Jikko Iinkai Kinen Shuppanbukai, Nov. 30, 1991, pp. 498 to 502.

International Search Report in PCT/JP2015/078932, dated Jan. 12, 2016.

Office Action in CN Application No. 201580049385.3, dated Jan. 9, 2018. 12pp.

J.R. Davis, "Metals Handbook—Desk Edition", Dec. 1998, ASM International, USA, XP002777857, ISBN: 0-87170-654-7, p. 430, 3pp.

Extended European Search Report in EP Application No. 15850574.3, dated Feb. 16, 2018. 8pp.

* cited by examiner

METHOD FOR PRODUCING ALUMINUM ALLOY MEMBER, AND ALUMINUM ALLOY MEMBER OBTAINED BY SAME

RELATED APPLICATIONS

The present application is a National Phase of International Application Number PCT/JP2015/078932, filed Oct. 13, 2015, which claims priority to Japanese Application Number 2014-212671, filed Oct. 17, 2014.

TECHNICAL FIELD

The present invention relates to a method for producing an aluminum alloy member and to an aluminum alloy member, and particularly to a method for producing an aluminum alloy member by which an aluminum alloy member having high strength and high proof stress is obtained, and to an aluminum alloy member obtained by the same.

BACKGROUND ART

Conventionally, Al—Cu-based JIS 2000 series aluminum alloys and Al—Cu—Mg—Zn-based JIS 7000 series aluminum alloys capable of increased proof stress and strength were used in structural members of automobiles, aircraft, and the like (for example, see Patent Document 1). To improve formability such as bending processing of these aluminum alloys, aluminum alloy members for structural members were produced by performing W forming processing, in which the aluminum alloy after extrusion is softened by heat treatment (solution treatment) and formed, and then increasing strength by further heat treatment (aging treatment).

CITATION LIST

Patent Literature

Patent Document 1: Japanese Unexamined Patent Application Publication No. 2011-241449A

SUMMARY OF INVENTION

Technical Problems

However, in conventional methods for producing aluminum alloy members, after solution treatment by heat treatment, there are cases where natural aging occurs during cooling before forming processing and the rigidity of the aluminum alloy before forming processing gradually increases. For this reason, in conventional methods for producing aluminum alloy members, there were cases where non-uniformity occurred in the strength of the ultimately obtained aluminum alloy member through aging treatment of the aluminum alloy, and sufficient strength and proof stress were not necessarily obtained. Furthermore, in conventional methods for producing aluminum alloy members, if the holding time from after extrusion or after solution treatment by heat treatment until before forming processing was not controlled, there were cases where natural aging occurs and the rigidity of the aluminum alloy became non-uniform, and as a result, the load required for forming was non-uniform and spring-back after forming occurred, and sufficient formability was not obtained.

Additionally, methods for producing an aluminum alloy member by the use of an aluminum alloy with good formability at room temperature and methods by T5 treatment, which increases strength by artificial aging without solution treatment, have been studied. However, when these aluminum alloys having good formability were used, there were cases where sufficient strength was not obtained compared to when JIS 7000 series or JIS 2000 series aluminum alloys were used.

The present invention takes such facts into consideration, and an object thereof is to provide a method for producing an aluminum alloy member that exhibits excellent formability during a forming process and is capable of producing an aluminum alloy member that has high strength and high proof stress, and an aluminum alloy member obtained by this method.

Solution to Problems

The method for producing an aluminum alloy member of the present invention comprises a cooling step for cooling an aluminum (Al) alloy, containing not less than 1.6% by mass and not greater than 2.6% by mass of magnesium (Mg), not less than 6.0% by mass and not greater than 7.0% by mass of zinc (Zn), not greater than 0.5% by mass of copper (Cu), not less than 0.01% by mass and not greater than 0.05% by mass of titanium (Ti), with the balance made up of aluminum (Al) and unavoidable impurities; a strain processing step for introducing strain that refines precipitates precipitated in the crystal grains of the aluminum alloy after the cooling; and an aging treatment step for aging the aluminum alloy by heat treatment.

With this method for producing an aluminum alloy member, because the aluminum alloy contains predetermined amounts of magnesium, zinc, copper, and titanium, formability of the aluminum alloy improves and therefore forming without solution treatment is possible. Also, since titanium has the effect of refining the crystal grains of the molten metal, it can improve strength. In this method for producing an aluminum alloy member, because the precipitates that precipitate in the crystal grains of the aluminum alloy after the aging treatment step can be refined by strain introduced into the aluminum alloy in the strain processing step, the precipitates in the crystal grains are dispersed and can make the strength of the aluminum alloy member uniform. Therefore, a method for producing an aluminum alloy member capable of producing an aluminum alloy member that exhibits excellent formability during a forming process and has high strength and high proof stress can be realized.

In the method for producing an aluminum alloy member of the present invention, the aluminum alloy preferably contains one or two or more among manganese (Mn), chromium (Cr), and zirconium (Zr) in a total of not less than 0.15% by mass and not greater than 0.6% by mass. By this method, coarsening of the crystal grains of the aluminum alloy can be suppressed, and strength, resistance to stress corrosion cracking, and fatigue life can be improved.

In the method for producing an aluminum alloy member of the present invention, in the strain processing step, the strain is preferably introduced into the aluminum alloy in a temperature range of not lower than −10° C. and not higher than 200° C. By this method, formability and strength of the aluminum alloy are further improved.

In the method for producing an aluminum alloy member of the present invention, in the aging treatment step, the aluminum alloy is preferably heat treated in a temperature range of not lower than 100° C. and not higher than 200° C. By this method, changes in rigidity of the aluminum alloy due to natural aging are reduced and stabilized, and as a result, shape accuracy of the aluminum alloy member improves.

In the method for producing an aluminum alloy member of the present invention, the strain is preferably not less than 0.1% and not greater than 15% relative to the aluminum alloy. By this method, dispersibility of precipitates that precipitate inside the aluminum alloy after forming processing improves, and as a result, the strength of the aluminum alloy member can be further improved.

The method for producing an aluminum alloy member of the present invention preferably further comprises a natural aging step for holding at not lower than 0° C. and not higher than 40° C. for not less than 6 hours, the natural aging step being provided between the cooling step and the strain processing step. By this method, when the holding time and the temperature between the extrusion step and the forming step are controlled under fixed conditions, the rigidity of the aluminum alloy member, which changes due to natural aging, is stabilized, non-uniformity of formability is reduced, and the shape accuracy of the aluminum alloy member improves.

The method for producing an aluminum alloy member of the present invention preferably further comprises a solution treatment step for performing solution treatment by heat treatment in a temperature range of not lower than 400° C. and not higher than 500° C., the solution treatment step being provided between the cooling step and the natural aging step. By this method, the aluminum alloy softens for forming processing, and as a result, the formability and strength of the aluminum alloy improve.

The aluminum alloy member of the present invention is obtained by the above method for producing an aluminum alloy member.

With this aluminum alloy member, because the aluminum alloy contains predetermined amounts of magnesium, zinc, copper, and titanium, formability of the aluminum alloy improves and therefore forming without solution treatment is possible. Also, since titanium has the effect of refining the crystal grains of the molten metal, it can improve strength. In this aluminum alloy member, because strain is introduced into the aluminum alloy in the strain processing step, the precipitates in the crystal grains of the aluminum alloy after the aging treatment step can be refined. As a result, because fine precipitates in the aluminum alloy are uniformly dispersed, the strength of the aluminum alloy member can be greatly increased. Therefore, an aluminum alloy member that exhibits excellent formability during a forming process and has high strength and high proof stress can be realized.

In the aluminum alloy member of the present invention, a maximum particle size of precipitates within the crystal grains of the aluminum alloy member is preferably not greater than 40 nm. Due to this constitution, non-uniformity of the strength and proof stress of the aluminum alloy member can be reduced, and as a result, an aluminum alloy member having higher strength and high proof stress can be realized.

Advantageous Effect of Invention

According to the present invention, a method for producing an aluminum alloy member capable of producing an aluminum alloy member having excellent formability during a forming process and having high strength and high proof stress, and an aluminum alloy member obtained by this method, can be realized.

DESCRIPTION OF EMBODIMENTS

JIS 7000 series aluminum alloys and the like, which are widely used for structural members of automobiles, aircraft, and the like, require solution treatment, which softens the aluminum alloy by heat treatment at a predetermined temperature before forming processing (or after forming processing) in order to obtain sufficient formability and shape accuracy. However, when an aluminum alloy undergoes heat treatment, precipitates are formed in the crystal grains of the aluminum alloy due to strain and residual stress arising during cooling of the aluminum alloy for example or natural aging after cooling, and as a result, the rigidity of the aluminum alloy becomes non-uniform. When the rigidity of the aluminum alloy becomes non-uniform, the load required in forming of the aluminum alloy member changes and spring-back occurs after forming processing, and as a result, there are cases where the predetermined formability and shape accuracy are not obtained.

The present inventors discovered that by using an aluminum alloy of a predetermined composition and by introducing a predetermined strain into the aluminum alloy after hot formation of the aluminum alloy, it is possible to uniformly disperse precipitates that precipitate in the crystal grains of the aluminum alloy during natural aging and the like and prevent non-uniformity of the rigidity of an aluminum alloy member. They achieved the present invention based on this finding.

Hereinafter, embodiments of the present invention will be described in detail while referring to the attached drawings. Note that the present invention is not limited to the following embodiments and the present invention can be carried out by applying suitable modifications. Furthermore, an aluminum alloy member in the form of an extruded section produced by hot extrusion of an ingot of aluminum alloy is described in the examples below, but the present invention may also be applied to the production of an aluminum alloy member in the form of a rolled sheet produced by hot rolling of an ingot.

Figure 1A:
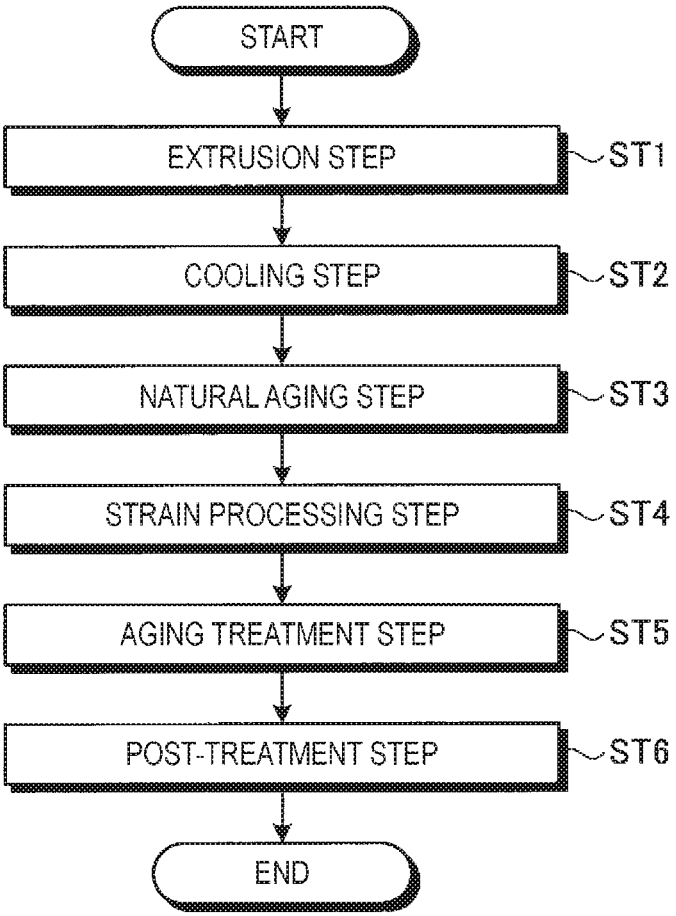
FIG. 1A is a flow chart illustrating an example of a method for producing an aluminum alloy member pertaining to an embodiment of the present invention.

FIG. 1A is a flow chart illustrating an example of a method for producing an aluminum alloy member pertaining to an embodiment of the present invention. As illustrated in FIG. 1A, the method for producing an aluminum alloy member pertaining to the present embodiment comprises: an extrusion step ST1 for heating an aluminum (Al) alloy, which contains not less than 1.6% by mass and not greater than 2.6% by mass of magnesium (Mg), not less than 6.0% by mass and not greater than 7.0% by mass of zinc (Zn), not greater than 0.5% by mass of copper (Cu), not less than 0.01% by mass and not greater than 0.05% by mass of titanium (Ti) with the balance made up of aluminum (Al) and unavoidable impurities, to a predetermined temperature (e.g., not lower than 400° C. and not higher than 550° C.), and extruding the aluminum alloy from a pressure-resistant mold; a cooling step ST2 for cooling the aluminum alloy extruded from the mold at a predetermined cooling rate (e.g., not less than 2° C./sec) to obtain an aluminum alloy member; a natural aging step ST3 for holding the cooled aluminum alloy member at normal temperature (e.g., not lower than 0° C. and not higher than 40° C.) for not less than 6 hours to finely disperse precipitates that precipitate in the crystal grains; a strain processing step ST4 for introducing strain that refines and disperses precipitates that precipitated in the crystal grains of the aluminum alloy due to natural aging or the like; an aging treatment step ST5 for aging the strain-processed aluminum alloy by heat treatment (e.g., not lower than 100° C. and not higher than 200° C.); and a post-treatment step ST6 for performing surface treatment and coating on the aged aluminum alloy member.

Note that in the example illustrated in FIG. 1A, a natural aging step ST3 is implemented before the strain processing step ST4, but the natural aging step ST3 is not necessarily required as long as the strain processing step ST4 can be performed after the cooling step ST2. Furthermore, in the example illustrated in FIG. 1A, an aging treatment step ST5 and a post-treatment step ST6 are implemented after the strain processing step ST4, but the post-treatment step ST6 may be performed according to necessity.

Figure 1B:
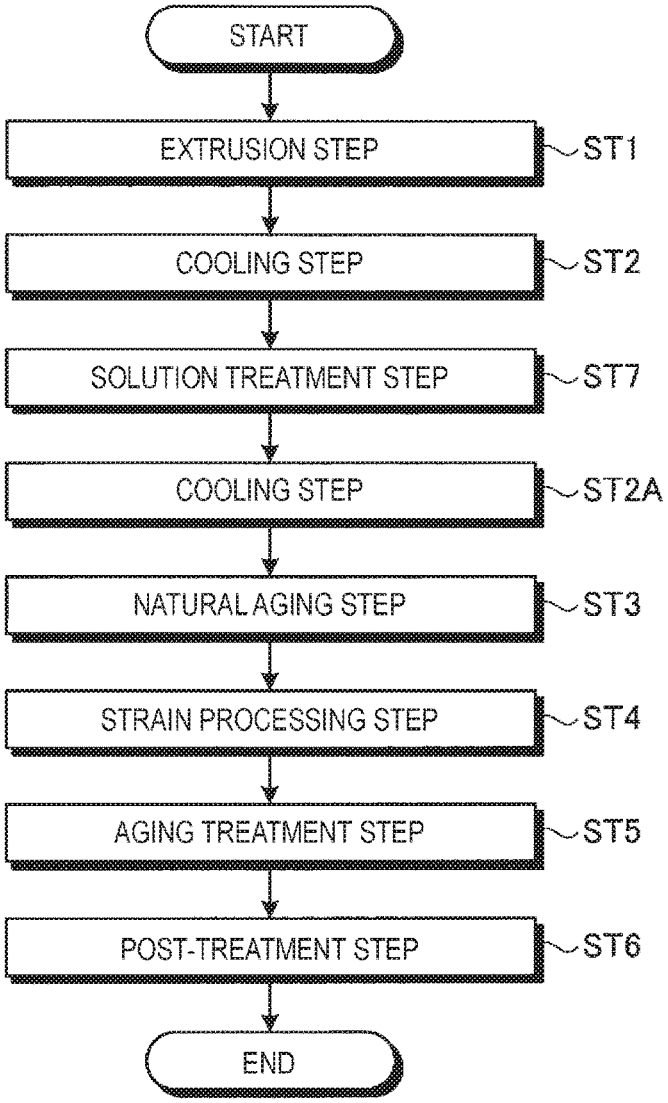
FIG. 1B is a flow chart illustrating another example of a method for producing an aluminum alloy member pertaining to an embodiment of the present invention.

Additionally, in the example illustrated in FIG. 1A, the strain processing step ST4 is implemented after the cooling step ST2, but, as illustrated in FIG. 1B, the present invention may be carried out in the following order: extrusion step ST1, cooling step ST2, solution treatment step ST7, cooling step ST2A, natural aging step ST3, strain processing step ST4, aging treatment step ST5, post-treatment step ST6. The aluminum alloy used in the method for producing an aluminum alloy member pertaining to the present embodiment will be described in detail below.

Aluminum Alloy

As the aluminum alloy, a 7000 series aluminum alloy having an Al—Zn—Mn-based composition and an Al—Zn—Mg—Cu-based composition including JIS standards and AA standards (simply called "7000 series aluminum alloy" hereinafter) is used. By using this 7000 series aluminum alloy, a high-strength aluminum alloy member having a strength, i.e., 0.2% proof stress, of not less than 400 MPa can be obtained by performing artificial aging treatment for not less than 6 hours and not greater than 16 hours at a temperature of not lower than 120° C. and not higher than 160° C. with T5 to T7 treatments.

As the aluminum alloy, an alloy of a composition containing not less than 1.6% by mass and not greater than 2.6% by mass of magnesium (Mg), not less than 6.0% by mass and not greater than 7.0% by mass of zinc (Zn), not greater than 0.5% by mass of copper (Cu), not less than 0.01% by mass and not greater than 0.05% by mass of titanium (Ti), with the balance made up of aluminum (Al) and unavoidable impurities is used. By using an aluminum alloy having such a composition, the aluminum alloy member having the strength, i.e., 0.2% proof stress, of not less than 400 MPa can be obtained.

Magnesium (Mg) is an element that improves the strength of the aluminum alloy member. From the perspective of improving the strength of the aluminum alloy member, the content of magnesium (Mg) is preferably not less than 1.6% by mass and not greater than 2.6% by mass or not greater than 1.9% by mass relative to the total mass of the aluminum alloy. When the content of magnesium (Mg) is greater than 2.6% by mass, the productivity for the extruded section decreases, with the extrusion pressure increasing or the extrusion speed decreasing during the extrusion processing, for example. Considering the above fact, the content of magnesium (Mg) is in a range of not less than 1.6% by mass and not greater than 2.6% by mass, and preferably in a range of not less than 1.6% by mass and not greater than 1.9% by mass, relative to the total mass of the aluminum alloy.

Zinc (Zn) is an element that improves the strength of the aluminum alloy member. From the perspective of improving the strength of the aluminum alloy member, the content of zinc (Zn) is not less than 6.0% by mass, and preferably not less than 6.4% by mass and not greater than 7.0% by mass, relative to the total mass of the aluminum alloy. When the content of zinc (Zn) is greater than 7.0% by mass, the amount of the grain boundary precipitate $MgZn_2$ increases and resistance to stress corrosion cracking (SCC) decreases. Therefore, the content of zinc (Zn) is not greater than 7.0% by mass. Considering the above fact, the content of zinc (Zn) is in a range of not less than 6.0% by mass and not greater than 7.0% by mass, and preferably in a range of not less than 6.4% by mass and not greater than 7.0% by mass, relative to the total mass of the aluminum alloy.

Copper (Cu) is an element that improves strength of the aluminum alloy member and its resistance to stress corrosion cracking (SCC). From the perspective of improving the strength and the resistance to stress corrosion cracking and from the perspective of extrusion formability of the aluminum alloy member, the content of copper (Cu) is from 0% by mass to 0.5% by mass relative to the total mass of the aluminum alloy.

Titanium (Ti) forms $Al_3Ti$ during casting of the aluminum alloy and has the effect of refining crystal grains. The content of titanium (Ti) is not less than 0.01% by mass and not greater than 0.05% by mass relative to the total mass of the aluminum alloy. When the content of titanium (Ti) is greater than 0.05% by mass, resistance to stress corrosion cracking decreases. Considering the above fact, the content of titanium is preferably not less than 0.01% by mass and not greater than 0.05% by mass relative to the total mass of the aluminum alloy.

Examples of unavoidable impurities include iron (Fe) and silicon (Si) and the like, which inevitably find their way into the aluminum alloy from its unprocessed metal and scrap and the like. From the perspective of maintaining the various characteristics of the aluminum alloy member as a product such as formability, corrosion resistance, and weldability, the content of unavoidable impurities is preferably not greater than 0.25% by mass of iron (Fe) and not greater than 0.05% by mass of silicon (Si).

Furthermore, an aluminum alloy containing one or two or more among manganese (Mn), chromium (Cr), and zirconium (Zr) in a total of not less than 0.15% by mass and not greater than 0.6% by mass may also be used.

From the perspective that zirconium (Zr) forms $Al_3Zr$ and has the effects of improving strength of the aluminum alloy and improving the resistance to stress corrosion cracking because it prevents recrystallization and suppresses crystal grain coarsening, and from the perspective that it improves crack generation characteristics and improves fatigue life because it forms a fiber structure, the content of zirconium (Zr) is preferably not less than 0.15% by mass and preferably not greater than 0.6% by mass relative to the total mass of the aluminum alloy. As long as the zirconium (Zr) content is not greater than 0.6% by mass, strength improves without increasing quenching sensitivity. Considering the above facts, the content of zirconium (Zr) is preferably not less than 0.15% by mass and not greater than 0.6% by mass relative to the total mass of the aluminum alloy. Furthermore, the same effect is obtained even when some or all of the zirconium (Zr) is replaced with chromium (Cr) or manganese (Mn). For this reason, zirconium (Zr), manganese (Mn), and chromium (Cr) may be contained in a total amount of not less than 0.15% by mass and not greater than 0.6% by mass. Each step of the method for producing an aluminum alloy member pertaining to the present embodiment will be described in detail below.

Extrusion Step: ST1

In the extrusion step ST1, an aluminum alloy adjusted to within the range of the composition described above is melted and then casted by a melting and casting method such as semicontinuous casting (DC casting) to form an ingot (billet). Then, the casted ingot of aluminum alloy is heated to a temperature in a predetermined range (e.g., not lower than 400° C. and not higher than 500° C.), to perform homogenization heat treatment (soaking treatment). By so doing, segregation and the like in the crystal grains in the aluminum alloy ingot disappear, and the strength of the alloy improves. The heating time is, for example, not less than 2 hours. Then, the homogenized ingot of aluminum alloy is submitted to hot extrusion from a pressure-resistant mold in a predetermined temperature range (e.g., not lower than 400° C. and not higher than 500° C.).

Cooling Steps: ST2, ST2A

In the cooling step ST2, the aluminum alloy that has been formed into a desired shape is preferably cooled at a cooling rate not less than 2° C./sec. As long as the cooling rate is not less than 2° C./sec, the strength of the aluminum alloy can be prevented from decreasing. From the perspective of further improving the effect described above, the cooling rate of the aluminum alloy is preferably not less than 3° C./sec, and more preferably not less than 4° C./sec. The temperature after cooling in cooling step ST2 is, for example, not higher than 250° C.

In the cooling step ST2, the aluminum alloy is preferably air-cooled. By so doing, the aluminum alloy can be cooled easily and inexpensively. The cooling conditions are not particularly limited as long as the cooling rate is not less than 2° C./sec. As cooling conditions, for example, the aluminum alloy may be left to stand in an environment at normal temperature (not lower than 0° C. and not higher than 40° C.), and cooling may be performed by blowing air on the aluminum alloy that has been left to stand in the normal-temperature environment. Furthermore, water not less than 0° C. and not greater than 50° C. may be sprayed in mist form.

Natural Aging Step: ST3

In the natural aging step ST3, by holding the aluminum alloy member for not less than 6 hours at normal temperature (e.g., not lower than 0° C. and not higher than 40° C.), the elements put into solid solution in the extrusion step ST1 or the solution treatment step ST7 of FIG. 1B to be described later produce fine precipitates. To more homogeneously disperse the precipitates, a time of not less than 24 hours is preferred, and not less than 48 hours is more preferred.

Strain Processing Step: ST4

In the strain processing step ST4, the extruded aluminum alloy is submitted to strain processing in a predetermined temperature range (e.g., not lower than −10° C. and not higher than 200° C.). Furthermore, when strain processing is carried out at not lower than −10° C. and not higher than 40° C., the strain processing step ST4 is performed as necessary after the solution treatment step ST7 to be described later. Additionally, strain processing may be carried out with the aluminum alloy after the extrusion step ST1 maintained in the predetermined temperature range.

Figure 2:
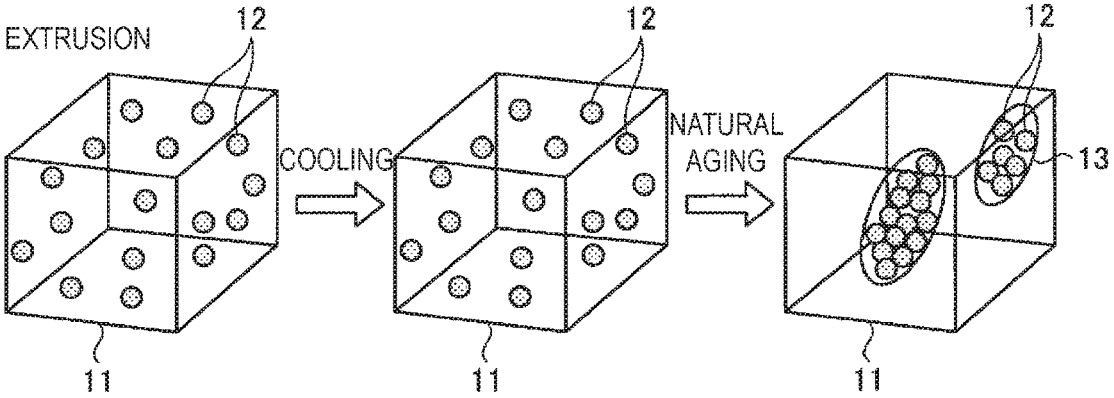
FIG. 2 is a schematic diagram of an aluminum alloy pertaining to a conventional embodiment.

In the strain processing step ST4, strain is introduced, which refines precipitates that precipitate in the crystal grains of the aluminum alloy in processes such as the natural aging step ST3 and the aging treatment step ST5 to be described later. FIG. 2 is a schematic diagram of an aluminum alloy pertaining to a conventional embodiment. As illustrated in FIG. 2, in the aluminum alloy 11 pertaining to a conventional embodiment, in the state where it has been heated to high temperature (e.g., approximately 500° C.) in the extrusion step, metal atoms 12 such as magnesium (Mg), zinc (Zn), and copper (Cu) contained in the aluminum alloy 11 are present in solid solution in the aluminum (Al). Then, after the aluminum alloy has been cooled in the cooling step, when held at normal temperature in the natural aging step ST3, the metal atoms 12 form an aggregate in which they have aggregated inside the crystal grains of the aluminum alloy due to natural aging, and the aluminum (Al), magnesium (Mg), zinc (Zn), copper (Cu), and the like undergo precipitation hardening in the crystal grains to form precipitates 13 such as θ phase (Al—Cu compound) and η phase (MgZn compound). When these precipitates 13 are formed, rigidity changes, and the formation load in the subsequent forming processing changes, and formability and shape accuracy decrease due to spring-back after forming processing. Furthermore, when precipitates are produced due to natural aging and then the aluminum alloy undergoes aging treatment in the subsequent aging treatment step, there are cases where precipitates are produced in a concentrated manner at the crystal grain boundaries and grow within the crystal grains, and as a result, the distribution of the metal atoms 12 in the aluminum alloy 11 becomes non-uniform, and the strength of the ultimately produced aluminum alloy member becomes non-uniform.

Figure 3A:
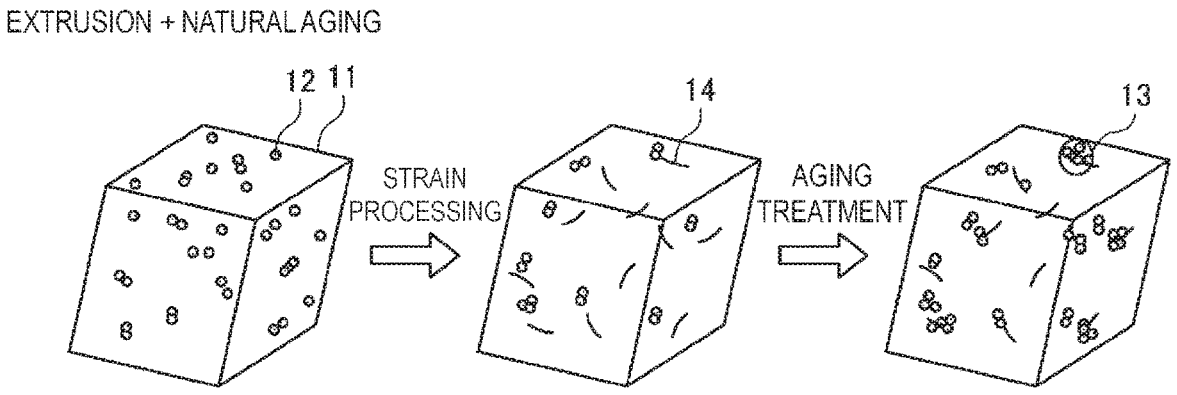
FIG. 3A is a schematic diagram of a method for producing an aluminum alloy member pertaining to an embodiment of the present invention.
Figure 3B:
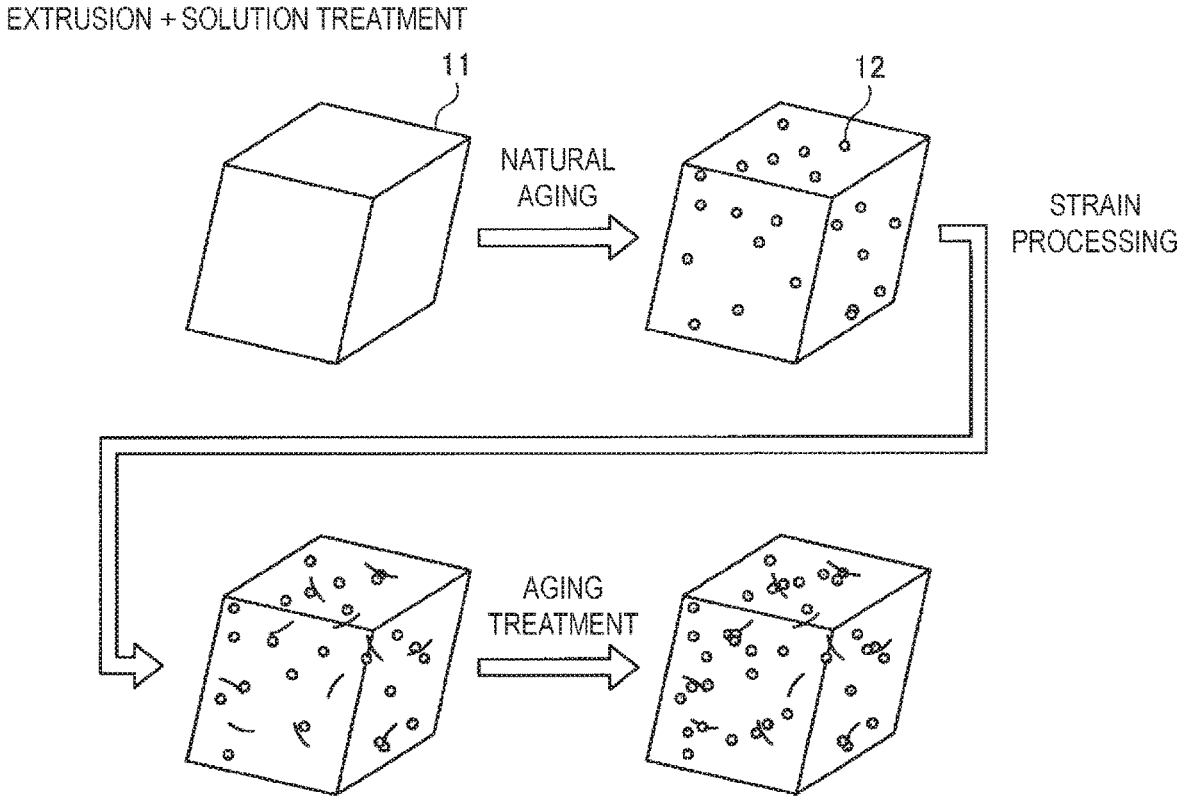
FIG. 3B is a schematic diagram of a method for producing an aluminum alloy member pertaining to an embodiment of the present invention.

Thus, in the present embodiment, by introducing a predetermined strain into the aluminum alloy 11 in the strain processing step ST4, the generation and growth rate of precipitates that are formed in the crystal grains of the aluminum alloy in the aging step ST5 are suppressed. FIGS. 3A and 3B are schematic diagrams of methods for producing an aluminum alloy member pertaining to embodiments of the present invention. In the example illustrated in FIG. 3A, for example, after extrusion at a high temperature of not lower than 400° C. and not higher than 500° C., the aluminum alloy 11 is cooled to a normal temperature of not lower than 0° C. and not higher than 40° C. and held at normal temperature for not less than 6 hours, and then a predetermined strain 14 is introduced into the aluminum alloy 11. By introducing this strain 14, aggregation of metal atoms 12 inside the aluminum alloy 11 can be delayed even in cases where it has passed through the cooling step ST2 and the aging treatment step ST5. As a result, the metal atoms 12 in the crystal grains of the aluminum alloy 11 are uniformly distributed and the formation of the precipitates 13 due to precipitation hardening of the metal atoms 12 can be prevented, and the strength of the ultimately produced aluminum alloy member can be prevented from becoming non-uniform.

Furthermore, in the example illustrated in FIG. 3B, the aluminum alloy 11 is cooled to a normal temperature of not lower than 0° C. and not higher than 40° C., solution treatment is performed, it is cooled again, natural aging is performed, and then a predetermined strain is introduced into the aluminum alloy 11. By introducing this strain, aggregation of the metal atoms 12 inside the aluminum alloy 11 can be prevented even in cases where it has passed through the aging treatment step ST5. As a result, the metal atoms 12 in the crystal grains of the aluminum alloy 11 are uniformly distributed and the formation of precipitates due to precipitation hardening of the metal atoms 12 can be prevented, and the strength of the ultimately produced aluminum alloy member can be prevented from becoming non-uniform.

The strain to be introduced into the aluminum alloy is not particularly limited as long as it is permanent strain capable of refining precipitates occurring inside the aluminum alloy. For example, it may be positive strain produced by stretching processing of the aluminum alloy, or negative strain produced by compressive processing. Additionally, it may be transverse strain produced in the direction orthogonal to the stretching direction and compression direction, or shear strain produced by pressing on a corner of a rectangular aluminum alloy.

From the perspective of efficiently refining precipitates that precipitate inside the aluminum alloy, the strain introduced into the aluminum alloy in the case where the aluminum alloy is processed at normal temperature is preferably not less than 0.1%, more preferably not less than 1.0%, and even more preferably not less than 3.0%, relative to the aluminum alloy. Furthermore, from the perspective of suppressing the occurrence of cracking of the aluminum alloy member due to plastic deformation, it is preferably not greater than 15%, more preferably not greater than 12.5%, even more preferably not greater than 10.0%, yet more preferably not greater than 7.5%, and yet more preferably not greater than 5%. When the strain introduced into the aluminum alloy is not less than 0.1%, the η phase which precipitates in the aging treatment step ST5 can be refined and dispersed.

The strain processing is not particularly limited as long as it can introduce strain into the desired aluminum alloy member. Examples of the strain processing include plastic working accompanied by generation of residual stress and plastic deformation, such as complete or partial stretching processing in the longitudinal direction of the aluminum alloy extruded section, bending processing, partial crushing of the cross-section of the extruded section, blanking operation of the extruding material, and twisting of the extruded section. One or two or more types of this strain processing may be implemented.

Aging Treatment Step: ST5

In the aging treatment step ST5, the aluminum alloy member is submitted to aging treatment by heat treatment in a predetermined temperature range (e.g., not lower than 100° C. and not higher than 200° C.). By so doing, changes in rigidity of the aluminum alloy due to natural aging are reduced and stabilized, and as a result, shape accuracy of the aluminum alloy member improves. From the perspective of strength of the aluminum alloy member, the aging treatment temperature is preferably not lower than 100° C. and more preferably not lower than 125° C., and preferably not higher than 200° C. and more preferably not higher than 175° C.

The time of aging treatment is preferably not less than 6 hours. As a result, changes in rigidity of the aluminum alloy due to natural aging are stabilized, and consequently, shape accuracy of the aluminum alloy member improves. The time of aging treatment is preferably not greater than 48 hours. As a result, excessive coarsening of the precipitates is suppressed, and consequently, a decrease in strength of the aluminum alloy can be prevented.

Post-Treatment Step: ST6

In the post-treatment step, surface treatment and coating are performed from the perspectives of improving corrosion resistance, abrasion resistance, decoration, anti-reflective properties, conductivity, film thickness uniformity, and workability. Examples of surface treatment include anodizing treatment, chromate treatment, non-chromate treatment, electroplating treatment, electroless plating treatment, chemical polishing, electropolishing, and the like.

Solution Treatment Step: ST7

After the extrusion step ST1 and the cooling step ST2, the aluminum alloy is heated to a temperature in a predetermined range (e.g., not lower than 400° C. and not higher than 500° C.), to perform homogenization heat treatment (soaking treatment). As a result, the elements that segregated in the crystal grains of the aluminum alloy are dispersed and homogenized. The heating time is, for example, not less than 2 hours. After that, by performing the cooling step ST2A, a supersaturated solid solution, in which magnesium (Mg) and copper (Cu) are dispersed in amounts not less than the saturation quantities in the crystal grains of the aluminum alloy, is formed.

As described above, in the method for producing an aluminum alloy member pertaining to the embodiment described above, because the precipitates that precipitate in the crystal grains of the aluminum alloy after processing can be refined by the strain introduced into the aluminum alloy in the strain processing step, the fine precipitates are dispersed and can greatly increase the strength of the aluminum alloy member. As a result, an aluminum alloy with a 0.2% proof stress of not less than 430 MPa, a tensile strength of not less than 500 MPa, and a maximum particle size of precipitates of not greater than 40 nm can be produced with high shape accuracy. Note that maximum particle size means the particle size value at which the length of a straight line from one surface of the precipitate to another surface of the precipitate is the longest.

EXAMPLES

Hereinafter, the present invention will be described in further detail based on working examples performed to make the effects of the present invention clear. Note that the present invention is not in any way limited by the working examples described below.

Working Example 1

An aluminum (Al) alloy containing 1.68% by mass of magnesium (Mg), 6.70% by mass of zinc (Zn), 0.26% by mass of copper (Cu), 0.02% by mass of titanium (Ti), 0.25% by mass of manganese (Mn), and 0.19% by mass of zirconium (Zr) was extruded and then cooled to not greater than 200° C. at a rate of 20° C./sec. Then, the aluminum alloy was held for not less than 24 hours, after which 0.50% strain was introduced to produce an aluminum alloy member. After that, tensile strength and proof stress were measured in conformance with the metal material test method set forth in ASTM E8 using an ASTM E557 tensile test piece sampled from a desired location of the produced aluminum alloy member. As a result, the 0.2% proof stress was 466 MPa, and the tensile strength was 531 MPa. Note that these measured values were the average of the measured values of three sampled test pieces for each example.

Working Example 2

An aluminum alloy member was produced in the same manner as Working Example 1 except that 1.20% strain was introduced into the aluminum alloy. As a result, the 0.2% proof stress was 497 MPa, and the tensile strength was 542 MPa.

Working Example 3

An aluminum alloy member was produced in the same manner as Working Example 1 except that 3.20% strain was introduced into the aluminum alloy. As a result, the 0.2% proof stress was 504 MPa, and the tensile strength was 544 MPa.

Comparative Example 1

An aluminum alloy member was produced in the same manner as Working Example 1 except that the general aluminum alloy Duralumin (JIS 7075 series aluminum alloy) was used and 0.35% strain was introduced into the aluminum alloy. As a result, the 0.2% proof stress was 479 MPa, and the tensile strength was 540 MPa.

Comparative Example 2

An aluminum alloy member was produced in the same manner as Comparative Example 1 except that 2.10% strain was introduced into the aluminum alloy. As a result, the 0.2% proof stress was 466 MPa, and the tensile strength was 532 MPa.

Figure 4:
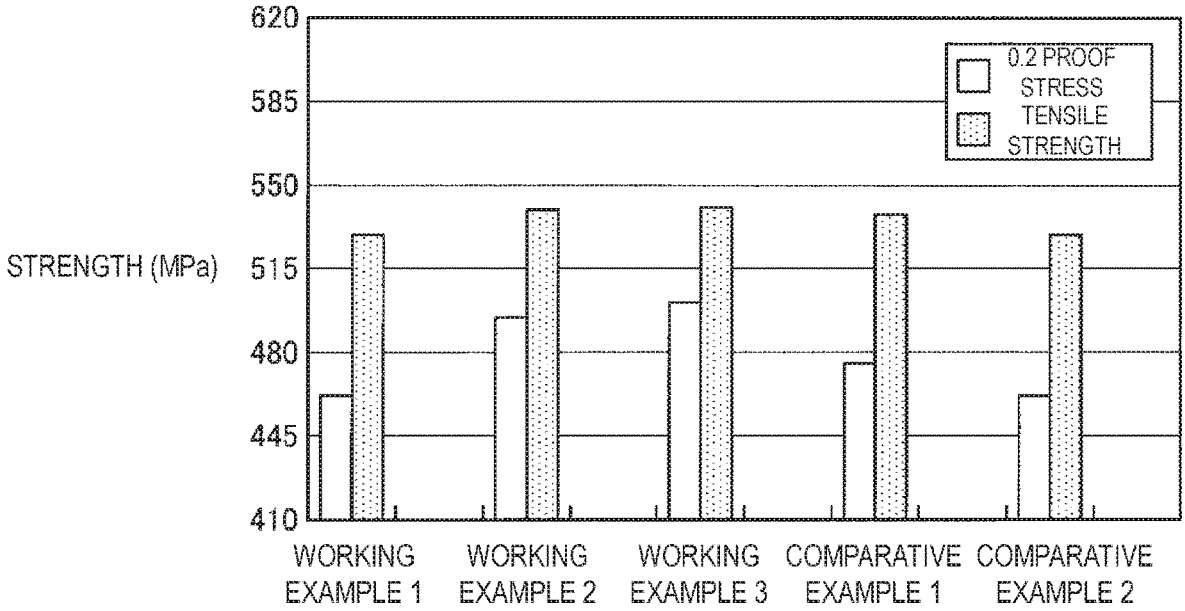
FIG. 4 is a diagram illustrating strengths of aluminum alloy members pertaining to working examples of the present invention and comparative examples.

The results of the above working examples and comparative examples are shown in FIG. 4. As illustrated in FIG. 4, in the aluminum alloy members of Working Examples 1 to 3, proof stress and strength did not decrease even when strain was applied, and furthermore, proof stress and strength tended to increase as strain was increased. In contrast, in Comparative Examples 1 and 2, proof stress and strength similar to those of Working Example 1 were obtained, but proof stress and strength tended to decreases as strain was increased.

Figure 5:
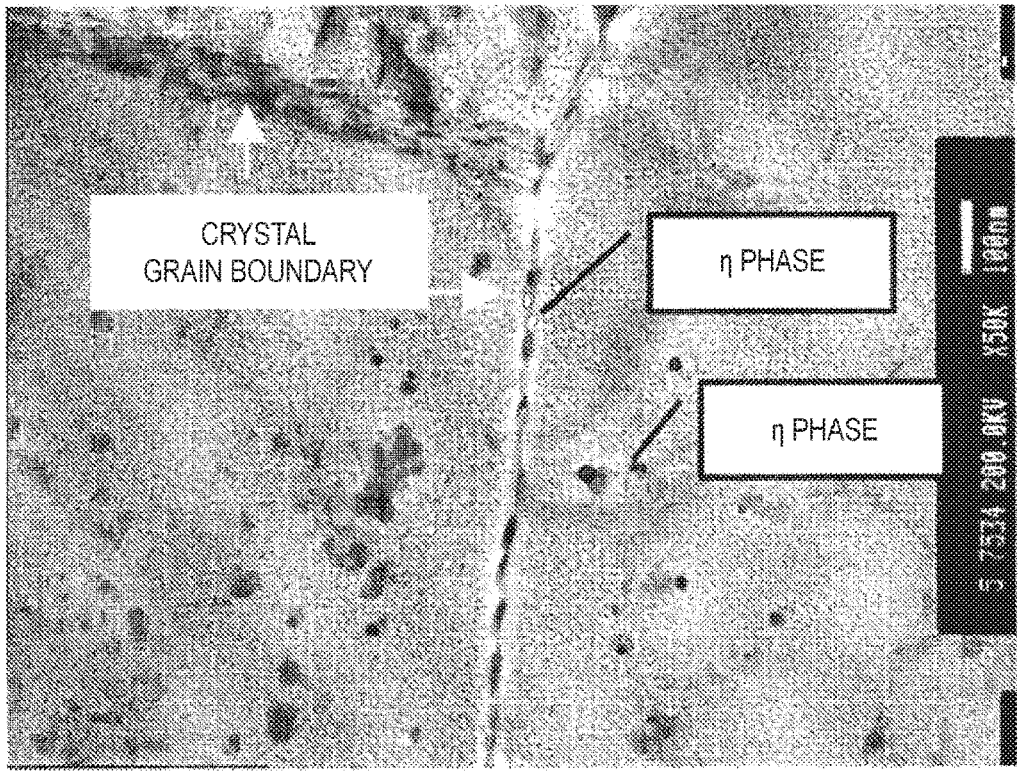
FIG. 5 is a transmission electron microscope photograph of an aluminum alloy member pertaining to a working example of the present invention.
Figure 6:
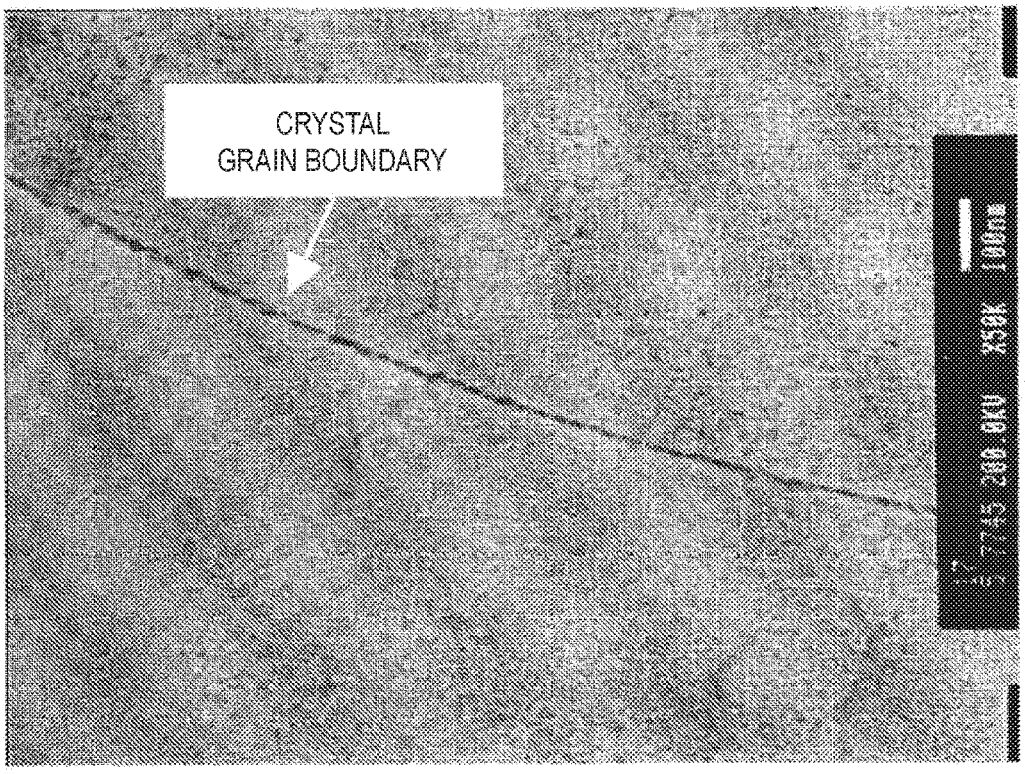
FIG. 6 is a transmission electron microscope photograph of an aluminum alloy member pertaining to a working example of the present invention.

Transmission electron microscope photographs of the aluminum alloy members of Working Examples 1 to 3 are shown in FIGS. 5 and 6. Note that FIGS. 5 and 6 show the results of measuring the maximum size of the η phase of each of three areas measuring 550 nm×800 nm observed by transmission electron microscope. As shown in FIGS. 5 and 6, in the aluminum alloy member of Working Example 1, the η phase (MgZn compound) which precipitates in the aging treatment step was refined and uniformly dispersed, and was a maximum of 40 nm long and 10 nm wide.

Figure 7:
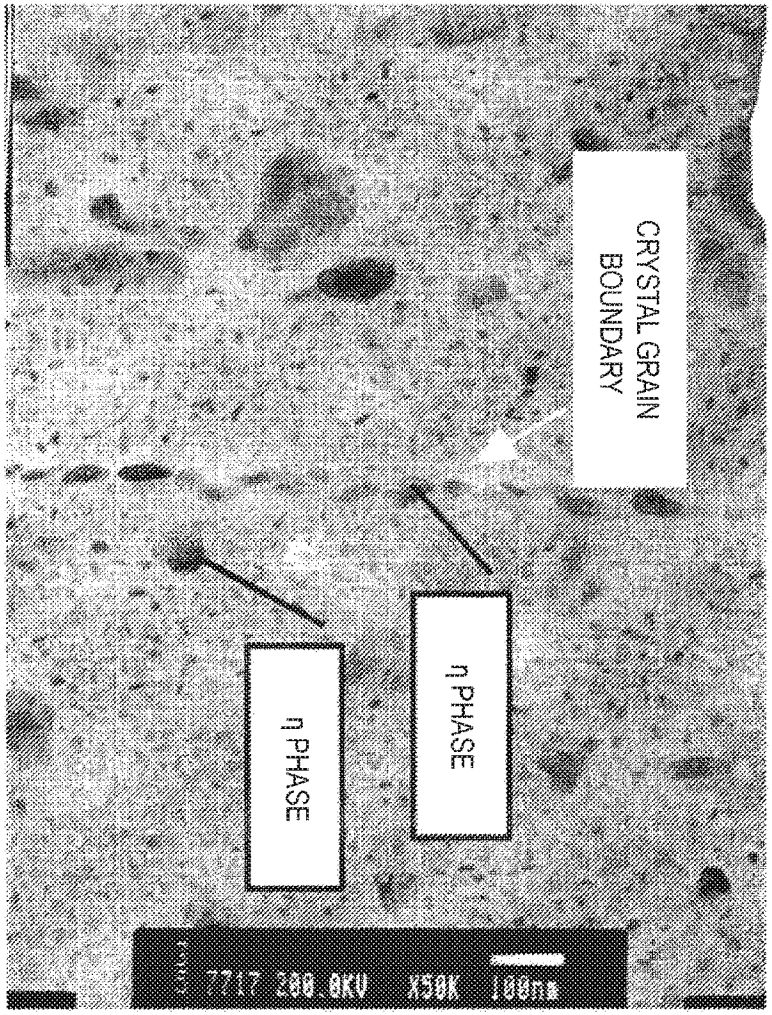
FIG. 7 is a transmission electron microscope photograph of an aluminum alloy member pertaining to a working example of the present invention.
Figure 8:
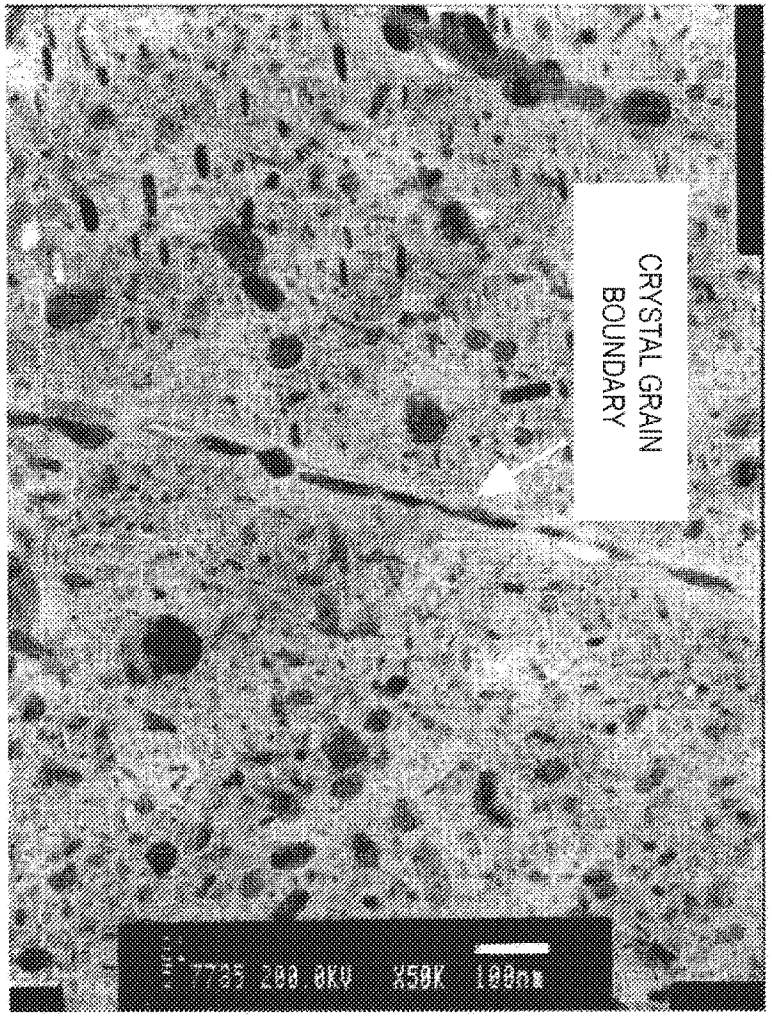
FIG. 8 is a transmission electron microscope photograph of an aluminum alloy member pertaining to a working example of the present invention.

Transmission electron microscope photographs of the aluminum alloy members of Comparative Examples 1 and 2 are shown in FIGS. 7 and 8. Note that FIGS. 7 and 8 show the results of measuring the maximum size of the η phase of each of three areas measuring 550 nm×800 nm observed by transmission electron microscope. As shown in FIGS. 7 and 8, in the aluminum alloy member of Comparative Example 1, a plurality of η phases (MgZn compound) had precipitated in the crystal grains after aging treatment. Each of the precipitates was coarsened into a spherical shape with a maximum particle size of not less than 44 nm, and was uniformly dispersed. From these results, it was found that with general aluminum alloy, coarsening of the η phase cannot be prevented even when strain is introduced, and strength also decreases.

REFERENCE SIGNS LIST

11 Aluminum alloy
12 Metal atom
13 Precipitate

The invention claimed is:

1. A method for producing an aluminum alloy member comprising:

an extrusion step for subjecting an aluminum (Al) alloy, containing not less than 1.6% by mass and not greater than 2.6% by mass of magnesium (Mg), not less than 6.0% by mass and not greater than 7.0% by mass of zinc (Zn), not greater than 0.5% by mass of copper (Cu), not less than 0.01% by mass and not greater than 0.05% by mass of titanium (Ti), with the balance made up of aluminum (Al) and unavoidable impurities, to hot extrusion;

a cooling step for cooling the aluminum alloy after the extrusion;

a strain processing step for introducing strain that refines precipitates precipitated in crystal grains of the aluminum alloy after the cooling; and an aging treatment step for aging the aluminum alloy by heat treatment;

a natural aging step for holding for not less than 6 hours at not lower than 0° C. and not higher than 40° C., the natural aging step being provided between the cooling step and the strain processing step, wherein the strain is not less than 0.1% and not greater than 5% relative to the aluminum alloy, and the aluminum alloy contains 0.15% to 0.6% by mass of chromium (Cr); and a solution treatment step for performing solution treatment by heat treatment in a temperature range of not lower than 400° C. and not higher than 500° C., the solution treatment step being provided between the cooling step and the natural aging step.

2. The method for producing an aluminum alloy member according to claim 1, wherein, in the strain processing step, the strain is introduced into the aluminum alloy in a temperature range of not lower than −10° C. and not higher than 200° C.

3. The method for producing an aluminum alloy member according to claim 1, wherein the aging treatment step is for heat treating the aluminum alloy in a temperature range of not lower than 100° C. and not higher than 200° C., for not less than 6 hours and not greater than 48 hours.

4. The method for producing an aluminum alloy member according to claim 1, wherein the aluminum alloy is Al—Cu—Mg—Zn-based aluminum alloys containing Cu.

* * * * *